US009797070B1

(12) United States Patent
Newton et al.

(10) Patent No.: US 9,797,070 B1
(45) Date of Patent: Oct. 24, 2017

(54) INTIMATE BLENDS OF CARBON-CONTAINING AND DYEABLE FIBERS

(71) Applicant: E I DU PONT DE NEMOURS AND COMPANY, Wilmington, DE (US)

(72) Inventors: Christopher William Newton, Richmond, VA (US); Reiyao Zhu, Moseley, VA (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 15/354,152

(22) Filed: Nov. 17, 2016

Related U.S. Application Data

(60) Provisional application No. 62/382,541, filed on Sep. 1, 2016.

(51) Int. Cl.

| | |
|---|---|
| ***D01F 6/80*** | (2006.01) |
| ***A41D 31/00*** | (2006.01) |
| ***D03D 1/00*** | (2006.01) |
| ***D03D 15/12*** | (2006.01) |

(52) U.S. Cl.
CPC ..... *D01F 6/805* (2013.01); *A41D 31/00* (2013.01); *A41D 31/0022* (2013.01); *D03D 1/00* (2013.01); *D03D 1/0035* (2013.01); *D03D 15/12* (2013.01)

(58) Field of Classification Search
None
See application file for complete search history.

(56) References Cited

U.S. PATENT DOCUMENTS

| | | | |
|---|---|---|---|
| 3,094,511 | A | 6/1963 | Hill et al. |
| 3,354,127 | A | 11/1967 | Hill et al. |
| 3,673,143 | A | 6/1972 | Bair et al. |
| 3,803,453 | A | 4/1974 | Hull |
| 3,819,587 | A | 6/1974 | Kwoleck |

(Continued)

FOREIGN PATENT DOCUMENTS

WO 0077283 A2 12/2000

OTHER PUBLICATIONS

Buxbaum, Industrial Inorganic Pigments, John Wiley & Sons, Jul. 2008, pp. 174.*

(Continued)

*Primary Examiner* — Shawnda McKinnon

(57) ABSTRACT

An intimate blend of staple fibers, and a yarn, fabric, and article of clothing providing surprising arc performance and coloration capability, comprising a mixture of a first staple fiber made from a flame resistant polymer that retains at least 90 percent of its weight when heated to 425 degrees Celsius at a rate of 10 degrees per minute and comprises 0.5 to 20 weight percent discrete homogeneously dispersed carbon particles; and either (a) a second staple fiber from a flame resistant polymer being free of discrete carbon particles and having an L* lightness coordinate of 70 or greater and being capable of accepting a dye or coloration, or (b) a second staple fiber blend being free of discrete carbon particles and comprising at least one second staple fiber from a flame resistant polymer and having an L* lightness coordinate of 70 or greater and being capable of accepting a dye or coloration; the mixture having a total content of 0.5 to 3 weight percent discrete carbon particles.

19 Claims, 1 Drawing Sheet

(56) References Cited

U.S. PATENT DOCUMENTS

| | | | | |
|---|---|---|---|---|
| 3,869,429 | A | 3/1975 | Blades | |
| 4,172,938 | A | 10/1979 | Mera et al. | |
| 4,612,150 | A | 9/1986 | De Howitt | |
| 4,668,234 | A | 5/1987 | Vance et al. | |
| 4,755,335 | A | 7/1988 | Ghorashi | |
| 4,883,496 | A | 11/1989 | Ghorashi | |
| 5,096,459 | A | 3/1992 | Ghorashi | |
| 2006/0010620 | A1* | 1/2006 | Krabbe | D01F 1/04 8/638 |
| 2009/0053951 | A1* | 2/2009 | Zhu | D01F 6/76 442/189 |
| 2012/0184166 | A1* | 7/2012 | Kurihara | D01F 6/625 442/181 |

OTHER PUBLICATIONS

Black, et al., "Fiber-Forming Aromatic Polyamides", Man-Made Fibers, Science and Technology, vol. 2, p. 297, Interscience Publishers, 1968.

* cited by examiner

INTIMATE BLENDS OF CARBON-CONTAINING AND DYEABLE FIBERS

BACKGROUND OF THE INVENTION

Field of the Invention

This invention relates to fiber blends, yarns, fabrics, and articles that provide protection to workers from electrical arcs.

Description of Related Art

Industrial workers and others who can be exposed to electrical arcs and the like need protective clothing and articles made from thermally resistant fabrics. Any increase in the effectiveness of these protective articles or any increase in the comfort of these articles while maintaining protection performance is welcomed.

Carbon particles have been used as a spun-in pigment in the coloration of fibers, the black color being effective in generating dark shades.

It has been found that if carbon particles are spun into fibers made from fire resistant and thermally stable polymers, the resulting yarns, fabrics, and garments provide dramatically improved arc protection. However, the carbon particles tend to make fibers having a dark shade, and arc-protective fabrics and garments of lighter shade are desired in many instances. For example, garments having darker shades are more difficult to see at night and in low-visibility situations. On the other hand, some garment manufacturers simply wish to have the ability to provide a variety of color shades to address the fashion choices of their customers.

Therefore, what is needed is a method to have arc protection that is both dramatically improved and has desirable color shades.

BRIEF SUMMARY OF THE INVENTION

This invention relates to an intimate blend of staple fibers, comprising a mixture of 3 to 80 weight percent of a first staple fiber made from a polymer having a limiting oxygen index greater than 21 and retaining at least 90 percent of its weight when heated to 425 degrees Celsius at a rate of 10 degrees per minute, the first staple fiber further comprising 0.5 to 20 weight percent discrete carbon particles homogeneously dispersed in that fiber; and 20 to 97 weight percent of either (a) a second staple fiber being free of discrete carbon particles and having an L* lightness coordinate of 70 or greater, the second staple fiber being capable of accepting a dye or coloration and made from a polymer having a limiting oxygen index of greater than 21, or (b) a second staple fiber blend being free of discrete carbon particles and comprising at least one second staple fiber, the second staple fiber having an L* lightness coordinate of 70 or greater and being capable of accepting a dye or coloration and made from a polymer having a limiting oxygen index of greater than 21; the mixture having a total content of 0.5 to 3 weight percent discrete carbon particles. This invention also relates to a yarn, fabric, and garment comprising this intimate blend of fibers.

This invention also relates to an intimate blend of staple fibers comprising a mixture of 3 to 49 weight percent of a first staple fiber made from a polymer having a limiting oxygen index (LOI) greater than 21 and retaining at least 90 percent of its weight when heated to 425 degrees Celsius at a rate of 10 degrees per minute, the first staple fiber further comprising 0.5 to 20 weight percent discrete carbon particles based on the amount of carbon particles in an individual fiber, homogeneously dispersed in that fiber; and 51 to 97 weight percent of either (a) a second staple fiber being free of discrete carbon particles, the second staple fiber being capable of accepting a dye or coloration and made from a polymer having a limiting oxygen index of greater than 21, or (b) a second staple fiber blend being free of discrete carbon particles and comprising at least one second staple fiber, the second staple fiber being capable of accepting a dye or coloration and made from a polymer having a limiting oxygen index of greater than 21; the mixture having a total content of 0.5 to 3 weight percent discrete carbon particles. This invention also relates to a yarn, fabric, and garment comprising this intimate blend of fibers.

DETAILED DESCRIPTION OF THE INVENTION

Figure 1:
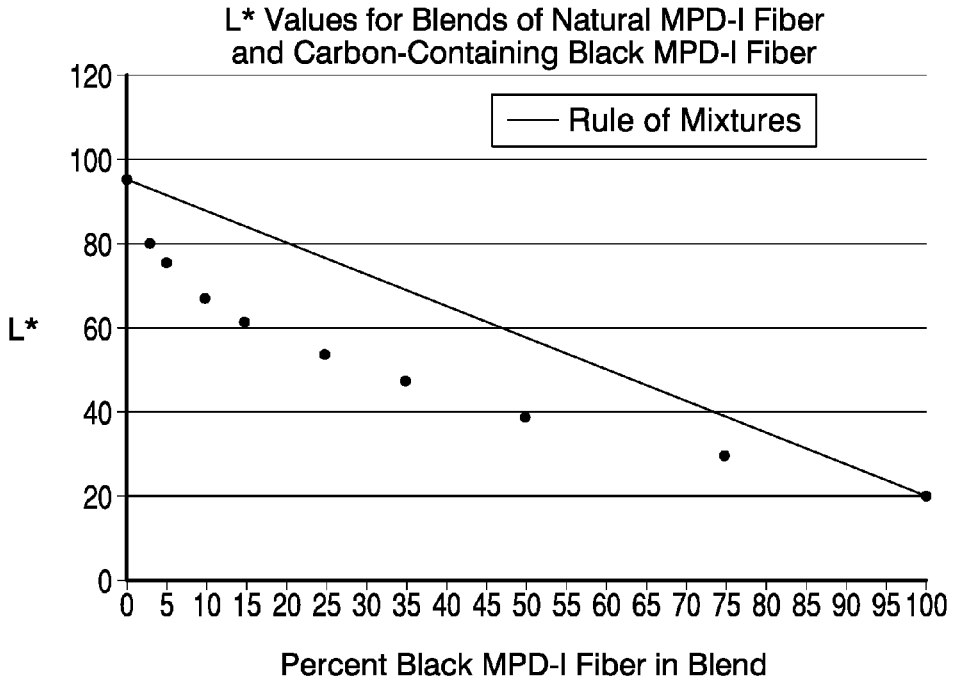
FIG. 1 shows the relationship of the measured lightness value L* of an intimate blend of natural poly(m-phenylene isophthalamide) (MPD-I) fiber that was free of carbon particles and MPD-I fiber that contained carbon particles, across the entire compositional range (0 to 100%).

This invention relates to fiber blends that have dramatically improved arc performance that can be colored in fiber, yarn, fabric, or article form to help mask the presence of the black carbon-containing fiber. In some embodiments, this invention relates to an intimate blend of staple fibers comprising a mixture of:

i) 3 to 80 weight percent of a first staple fiber made from a polymer having a limiting oxygen index greater than 21 and retaining at least 90 percent of its weight when heated to 425 degrees Celsius at a rate of 10 degrees per minute, the first staple fiber further comprising 0.5 to 20 weight percent discrete carbon particles homogeneously dispersed in that fiber; and ii) 20 to 97 weight percent of either:

a) a second staple fiber being free of discrete carbon particles, the second staple fiber having an L* lightness coordinate of 70 or greater and being capable of accepting a dye or coloration and made from a polymer having a limiting oxygen index of greater than 21, or b) a second staple fiber blend being free of discrete carbon particles and comprising at least one second staple fiber, the second staple fiber having an L* lightness coordinate of 70 or greater and being capable of accepting a dye or coloration and made from a polymer having a limiting oxygen index of greater than 21;

the mixture having a total content of 0.5 to 3 weight percent discrete carbon particles.

In some embodiments, this invention relates to an intimate blend of staple fibers comprising a mixture of:

i) 3 to 49 weight percent of a first staple fiber made from a polymer having a limiting oxygen index greater than 21 and retaining at least 90 percent of its weight when heated to 425 degrees Celsius at a rate of 10 degrees per minute, the first staple fiber further comprising 0.5 to 20 weight percent discrete carbon particles based on the amount of carbon particles in an individual fiber, homogeneously dispersed in that fiber; and ii) 51 to 97 weight percent of either:

a) a second staple fiber being free of discrete carbon particles, the second staple fiber being capable of accepting a dye or coloration and made from a polymer having a limiting oxygen index of greater than 21, or b) a second staple fiber blend being free of discrete carbon particles and comprising at least one second staple fiber, the second staple fiber being capable of accepting a dye or coloration and made from a polymer having a limiting oxygen index of greater than 21;

the mixture having a total content of 0.5 to 3 weight percent discrete carbon particles.

By fiber blend it is meant the combination of two or more staple fiber types in any manner. Preferably the staple fiber blend is an "intimate blend", meaning the various staple fibers in the blend form a relatively uniform mixture of the fibers. In some embodiments the two or more staple fiber types are blended prior to or while the staple fiber yarn is being spun so that the various staple fibers are distributed homogeneously in the staple yarn bundle. In some embodiments the intimate blend consists essentially of the first staple fiber and either the second staple fiber or the second staple fiber blend. In some preferred embodiments the intimate blend consists solely of the first staple fiber and either the second staple fiber or the second staple fiber blend.

For purposes herein, the term "fiber" is defined as a relatively flexible, macroscopically homogeneous body having a high ratio of length to the width of the cross-sectional area perpendicular to that length. The fiber cross section can be any shape, but is typically round or bean-shaped. Also, such fibers preferably have a generally solid cross section for adequate strength in textile uses; that is, the fibers preferably are not appreciably voided or do not have a large quantity of objectionable voids.

As used herein, the term "staple fibers" refers to fibers that are cut to a desired length or are stretch broken, or fibers that are made having a low ratio of length to the width of the cross-sectional area perpendicular to that length, when compared with continuous filaments. Man-made staple fibers are cut or made to a length suitable for processing on, for example, cotton, woolen, or worsted yarn spinning equipment. The staple fibers can have (a) substantially uniform length, (b) variable or random length, or (c) subsets of the staple fibers have substantially uniform length and the staple fibers in the other subsets have different lengths, with the staple fibers in the subsets mixed together forming a substantially uniform distribution.

In some embodiments, suitable staple fibers have a cut length of from 1 to 30 centimeters (0.39 to 12 inches). In some embodiments, suitable staple fibers have a length of 2.5 to 20 cm (1 to 8 in). In some preferred embodiments the staple fibers made by short staple processes have a cut length of 6 cm (2.4 in) or less. In some preferred embodiments the staple fibers made by short staple processes have a staple fiber length of 1.9 to 5.7 cm (0.75 to 2.25 in) with the fiber lengths of 3.8 to 5.1 cm (1.5 to 2.0 in) being especially preferred. For long staple, worsted, or woolen system spinning, fibers having a length of up to 16.5 cm (6.5 in) are preferred.

The staple fibers can be made by any process. For example, the staple fibers can be cut from continuous straight fibers using a rotary cutter or a guillotine cutter resulting in straight (i.e., non-crimped) staple fiber, or additionally cut from crimped continuous fibers having a saw tooth shaped crimp along the length of the staple fiber, with a crimp (or repeating bend) frequency of preferably no more than 8 crimps per centimeter. Preferably the staple fibers have crimp.

The staple fibers can also be formed by stretch breaking continuous fibers resulting in staple fibers with deformed sections that act as crimps. Stretch broken staple fibers can be made by breaking a tow or a bundle of continuous filaments during a stretch break operation having one or more break zones that are a prescribed distance creating a random variable mass of fibers having an average cut length controlled by break zone adjustment.

Spun staple yarn can be made from staple fibers using traditional long and short staple ring spinning processes that are well known in the art. However, this is not intended to be limiting to ring spinning because the yarns may also be spun using air jet spinning, open end spinning, and many other types of spinning that converts staple fiber into useable yarns. Spun staple yarns can also be made directly by stretch breaking using stretch-broken tow-to-top staple processes. The staple fibers in the yarns formed by traditional stretch break processes typically have length of up to 18 cm (7 in) long; however, spun staple yarns made by stretch breaking can also have staple fibers having maximum lengths of up to around 50 cm (20 in.) through processes as described for example in PCT Patent Application No. WO 0077283. Stretch broken staple fibers normally do not require crimp because the stretch-breaking process imparts a degree of crimp into the fiber.

In some embodiments the intimate blend of staple fibers preferably has a lightness coordinate or "L*" value of 40 or greater. Some embodiments also have a spectral reflectance of 20% or greater over the wavelengths of visible light (380 to 780 nm). In some embodiments, the intimate blend of staple fibers has a "L*" value of 50 or greater; and in some embodiments the intimate blend of staple fibers has a "L*" value of 60 or greater.

The color of intimate blends, yarns, fabrics, and garments can be measured using a spectrophotometer, also called a colorimeter, which provides three scale values "L*", "a*", and "b*" representing various characteristics of the color of the item measured, and the spectral reflectance. On the color scale, lower "L*" values generally indicate a darker color, with the color white having a value of about or near 100 and black having a color of about or near 0. In its natural state and before any coloration, natural poly(meta-phenylene isophthalamide) fiber has a slightly off-white color that when measured using a colorimeter has a "L*" value that ranges about 80 or greater. Poly(meta-phenylene isophthalamide) fiber further comprising 0.5 to 20 weight percent discrete carbon particles has a black color that when measured using a colorimeter has a "L*" value that ranges about 20 or less.

Surprisingly, it has been found that the lightness coordinate or "L*" of a mixture of natural poly(meta-phenylene isophthalamide) fiber, with its slightly off-white color; and poly(meta-phenylene isophthalamide) fiber having carbon particles dispersed therein, with its black color, is not governed by a simple rule of mixtures. FIG. 1 shows the relationship of the measured lightness value L* of the intimate blend across the entire compositional range (0 to 100%). Blends in the majority of the compositions across the compositional ranger are actually darker than one would expect by a simple rule of mixtures.

As used herein the colors attributed to the intimate blend of staple fibers also applies to yarns, fabrics, and garments incorporating the intimate blend; the same spectrophotometer can be used to determine the "L*" value of yarns, fabrics, and garments, which generally follow the "L*" value of the intimate blends.

In some embodiments, the intimate blend of staple fibers comprises 3 to 49 weight percent of a first staple fiber having discrete homogeneously dispersed carbon particles and 51 to 97 weight percent of a second staple fiber having an L* lightness coordinate of 70 or greater, or second staple fiber blend comprising such a second staple fiber. In some embodiments, the intimate blend of staple fibers comprises 5 to 35 weight percent of the first staple fiber having discrete homogeneously dispersed carbon particles and 65 to 95 weight percent of a second staple fiber having an L* lightness coordinate of 70 or greater, or second staple fiber blend comprising such a second fiber. In some embodiments, the intimate blend of staple fibers comprises 10 to 25 weight percent of the first staple fiber having discrete homogeneously dispersed carbon particles and 75 to 90 weight percent of a second staple fiber having an L* lightness coordinate of 70 or greater, or second staple fiber blend comprising such a second fiber. The weight percentages of first fiber and the second staple fiber, or second staple fiber blend, are based on the total of those items in the blend.

In some embodiments, the intimate blend of staple fibers comprises 5 to 35 weight percent of the first staple fiber having discrete homogeneously dispersed carbon particles and 65 to 95 weight percent of a second staple fiber capable of accepting a dye or coloration, or second staple fiber blend comprising such a second fiber. In some embodiments, the intimate blend of staple fibers comprises 10 to 25 weight percent of the first staple fiber and 75 to 90 weight percent of a second staple fiber capable of accepting a dye or coloration, or second staple fiber blend comprising such a second fiber. The weight percentages of first fiber and the second staple fiber or second staple fiber blend are based on the total of those items in the blend.

The intimate blend of staple fibers is useful in articles that provide arc protection for workers and other personnel. An arc flash is an explosive release of energy caused by an electrical arc. Electrical arcs typically involve thousands of volts and thousands of amperes of electrical current, exposing the garment to intense incident heat and radiant energy. To offer protection to a wearer, an article of protective apparel must resist the transfer of this incident energy through to the wearer. It has been believed that this occurs best when the article of protective apparel absorbs a portion of the incident energy while resisting what is called "break-open". During "break-open", a hole forms in the article. Therefore, protective articles or garments for arc protection have been designed to avoid or minimize break-open of any of the fabric layers in the garment.

It has been found that the arc performance of fabrics and garments can be increased on the order of almost two times by the addition of discrete carbon particles in the polymer of fire-resistant (i.e., having a limiting oxygen index greater than 21) and thermally stable fiber. As used herein, the term "thermally stable" means the polymer or fiber retains at least 90 percent of its weight when heated to 425 degrees Celsius at a rate of 10 degrees per minute.

Figure 2:
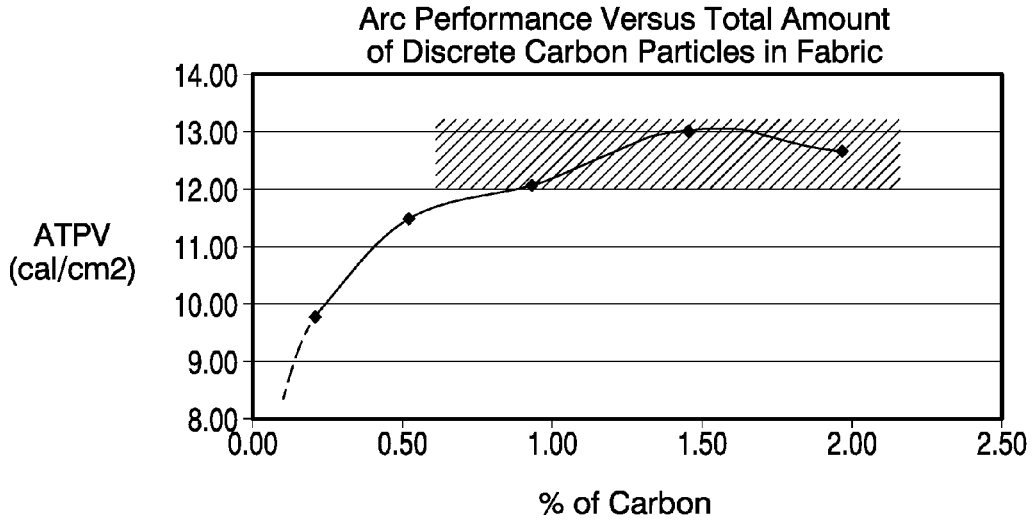
FIG. 2 shows the relationship of arc performance versus the total amount of discrete carbon particles in a fabric, normalized for a fabric having a basis weight of 6.3 oz/yd$^2$.

On a fabric weight basis, such dramatic improvement has been found when the total amount of discrete carbon particles in the fabric is 0.5 to 3 weight percent, based on the total amount of fiber in the fabric. FIG. 2 illustrates the ATPV of such a fabric containing carbon particles, normalized for a fabric having a basis weight of 6.3 oz/yd$^2$. As illustrated, the presence of carbon can have a significant effect on the fabric arc performance, as measured by ATPV, even at very low loadings. The best performance is found for carbon particles amounts of greater than about 0.5 weight percent in the fabric, with a preferred performance of 12 cal/cm$^2$ or greater occurring for fabrics having about 0.75 weight percent carbon particles or greater, with an especially desired range being 0.75 to 2 weight percent carbon particles in the fabric.

Further, it has been found that the arc performance of fabrics and garments made from the intimate blend of staple fibers, which contains the first staple fiber made from a polymer having a limiting oxygen index greater than 21 and retaining at least 90 percent of its weight when heated to 425 degrees Celsius at a rate of 10 degrees per minute, and having carbon particles homogeneously dispersed therein, has surprisingly improved arc performance while also being able to be colored (i.e., dyed) to light shades that help mask the presence of the carbon.

The intimate blend contains a first staple fiber made from a polymer having a limiting oxygen index greater than 21, the fiber further comprising 0.5 to 20 weight percent discrete carbon particles based on the amount of carbon particles in an individual fiber, homogeneously dispersed in that fiber. The first staple fiber is made from a polymer having a Limiting Oxygen Index (LOI) above the concentration of oxygen in air (that is, greater than 21 and preferably greater than 25). This means the fiber or a fabric made solely from that fiber will not support flame in the normal oxygen concentrations in air and is considered fire-resistant. The polymer of the first staple fiber further retains at least 90 percent of its weight when heated to 425 degrees Celsius at a rate of 10 degrees per minute, meaning that this fiber has high thermal stability. Preferably such polymers include such things polyaramids, polyazoles, polysufones and other thermoset polymers that preferably can be solution spun into fibers.

The first staple fiber comprises 0.5 to 20 weight percent discrete carbon particles, based on the amount of carbon particles in an individual fiber. In some embodiments, the first staple fiber comprises 0.5 to 10 weight percent discrete carbon particles, based on the amount of carbon particles in an individual fiber; in some embodiments the first staple fiber comprises 0.5 to 6 weight percent discrete carbon particles, based on the amount of carbon particles in an individual fiber. In some other embodiments, it is desirable to have 5 to 10 weight percent discrete carbon particles, based on the amount of carbon particles in an individual fiber. In one preferred embodiment the first staple fiber comprises 0.5 to 3.0 weight percent discrete carbon particles.

As present in the fiber, the carbon particles have an average particle size of 10 micrometers or less, preferably averaging 0.1 to 5 micrometers; in some embodiments an average particle size of 0.5 to 3 micrometers is preferred. In some embodiments an average particle size of 0.1 to 2 micrometers is desirable; and in some embodiments an average particle size of 0.5 to 1.5 micrometers is preferred. Carbon particles include such things as carbon black produced by the incomplete combustion of heavy petroleum products and vegetable oils. Carbon black is a form of paracrystalline carbon that has a higher surface-area-to-volume ratio than soot but lower than that of activated carbon. The particles can be incorporated into the fibers by adding the carbon particles to the spin dope prior to the formation of the fibers via spinning.

Essentially any commercially available carbon-black can be used to supply the discrete carbon particles to the aramid polymer composition. They are typically incorporated into the fibers by adding the carbon particles to the spin dope prior to the formation of the fibers via spinning. In one preferred practice, a separate stable dispersion of the carbon-black in a polymer solution, preferably an aramid polymer solution, is first made, and then the dispersion is milled to achieve a uniform particle distribution. This dispersion is the preferably injected into the aramid polymer solution prior to spinning.

The phrase "homogeneously dispersed in that fiber" means that the carbon particles can be found in the fibers uniformly distributed in both the axial and radial directions in the fiber. It is believed that one way of achieving this uniform distribution is by spinning, either by wet or dry spinning, a polymer solution containing the carbon particles.

In some preferred embodiments the polymer of the first staple fiber is a meta-aramid. As used herein, "aramid" is meant a polyamide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Meta-aramid are those aramids where the amide linkages are in the meta-position relative to each other. One preferred meta-aramid is poly(metaphenylene isophthalamide). Within the yarns, meta-aramid fiber provides a fire resistant fiber with an LOI typically at least about 25 or greater.

In some embodiments, the meta-aramid fiber has a minimum degree of crystallinity of at least 20% and more preferably at least 25%. For purposes of illustration, due to ease of formation of the final fiber, a practical upper limit of crystallinity is about 50% (although higher percentages are considered suitable). Generally, the crystallinity will be in a range from 25 to 40%. The degree of crystallinity of a meta-aramid fiber can be determined by one of two methods. The first method is employed with a non-voided fiber while the second is employed on a fiber that is not totally free of voids. The percent crystallinity of meta-aramids in the first method is determined by first generating a linear calibration curve for crystallinity using good, essentially non-voided samples. For such non-voided samples, the specific volume (1/density) can be directly related to crystallinity using a two-phase model. The density of the sample is measured in a density gradient column. A meta-aramid film, determined to be non-crystalline by x-ray scattering methods, was measured and found to have an average density of 1.3356 g/cm3. The density of a completely crystalline meta-aramid sample was then determined from the dimensions of the x-ray unit cell to be 1.4699 g/cm3. Once these 0% and 100% crystallinity end points are established, the crystallinity of any non-voided experimental sample for which the density is known can be determined from this linear relationship:

$$\text{Crystallinity} = \frac{(1/\text{non-crystalline density}) - (1/\text{experimental density})}{(1/\text{non-crystalline density}) - (1/\text{fully-crystalline density})}$$

Since many fiber samples are not totally free of voids, Raman spectroscopy is the preferred method to determine crystallinity. Since the Raman measurement is not sensitive to void content, the relative intensity of the carbonyl stretch at $1650^{-1}$ cm can be used to determine the crystallinity of a meta-aramid in any form, whether voided or not. To accomplish this, a linear relationship between crystallinity and the intensity of the carbonyl stretch at 1650 $cm^{-1}$, normalized to the intensity of the ring stretching mode at 1002 $cm^{-1}$, was developed using minimally voided samples whose crystallinity was previously determined and known from density measurements as described above. The following empirical relationship, which is dependent on the density calibration curve, was developed for percent crystallinity using a Nicolet Model 910 FT-Raman Spectrometer:

$$\%\ \text{Crystallinity} = \frac{100.0 \times (I(1650\ \text{cm}^{-1}) - 0.2601)}{0.1247}$$

where I(1650 $cm^{-1}$) is the Raman intensity of the meta-aramid sample at that point. Using this intensity, the percent crystallinity of the experiment sample is calculated from the equation.

Meta-aramid fibers, when spun from solution, quenched, and dried using temperatures below the glass transition temperature, without additional heat or chemical treatment, develop only minor levels of crystallinity. Such fibers have a percent crystallinity of less than 15 percent when the crystallinity of the fiber is measured using Raman scattering techniques. These fibers with a low degree of crystallinity are considered amorphous meta-aramid fibers that can be crystallized through the use of heat or chemical means. The level of crystallinity can be increased by heat treatment at or above the glass transition temperature of the polymer. Such heat is typically applied by contacting the fiber with heated rolls under tension for a time sufficient to impart the desired amount of crystallinity to the fiber.

The level of crystallinity of m-aramid fibers can also be increased by a chemical treatment, and in some embodiments this includes methods that color, dye, or mock dye the fibers prior to being incorporated into a fabric. Some methods are disclosed in, for example, U.S. Pat. Nos. 4,668,234; 4,755,335; 4,883,496; and 5,096,459. A dye assist agent, also known as a dye carrier may be used to help increase dye pick up of the aramid fibers. Useful dye carriers include aryl ether, benzyl alcohol, or acetophenone.

The intimate blend contains a second staple fiber capable of accepting a dye or coloration or second staple fiber blend comprising such a second fiber. In other words, the intimate blend further contains a single type of staple fiber, or the intimate blend further contains two or more staple fibers. The second staple fiber is free of discrete carbon particles, meaning that the fiber does not contain carbon particles as defined herein. The second staple fiber blend is also free of discrete carbon particles, meaning that none of fibers in the blend of staple fibers contain carbon particles as defined herein. The other fibers in the second staple fiber blend are not limited. In one embodiment, the second staple fiber is present as a majority staple fiber (greater than 50 weight percent) in the second staple fiber blend.

The second staple fiber is made from polymers and copolymers having an LOI of greater than 21. Preferably, the polymer of the second staple fiber is also thermally stable, meaning that the polymer of the second staple fiber also retains at least 90 percent of its weight when heated to 425 degrees Celsius at a rate of 10 degrees per minute. Preferably such polymers include such things polyaramids, polyazoles, polysufones and other thermoset polymers that preferably can be solution spun into fibers.

In some preferred embodiments the polymer of the second staple fiber is a meta-aramid as previously described herein. One preferred meta-aramid is poly(metaphenylene isophthalamide). In some embodiments, the meta-aramid fiber has a minimum degree of crystallinity of at least 20% and more preferably at least 25%. For purposes of illustration, due to ease of formation of the final fiber, a practical upper limit of crystallinity is 50% (although higher percentages are considered suitable). Generally, the crystallinity will be in a range from 25 to 40%.

In some embodiments, the second staple fiber has an axial thermal shrinkage at 185 degrees Celsius of greater than 10 percent and is made from a polymer having a limiting oxygen index of greater than 21 that is thermally stable as previously defined. This high level of shrinkage is representative of an amorphous fiber that has not been appreciably crystallized or otherwise heat stabilized. The amorphous polymer of the second staple fiber is preferably meta-aramid as previously described herein. When the fiber is a meta-aramid fiber, such fibers generally have a percent crystallinity of less than 15 percent when the crystallinity of the fiber is measured using Raman scattering techniques. Due to the lack of crystallinity, such fibers can be relatively easily dyed, either in intimate blend, yarn, fabric, or article form. One preferred meta-aramid is poly(metaphenylene isophthalamide).

In another embodiment, the second staple fiber has an axial thermal shrinkage at 185 degrees Celsius of 2 percent or less and is made from a polymer having a limiting oxygen index of greater than 21 that is thermally stable as previously defined. This low level of shrinkage is representative of a relatively crystallized fiber. The polymer of the second staple fiber is preferably meta-aramid as previously described herein. When the fiber is a meta-aramid fiber, it preferably has a minimum degree of crystallinity of at least 20% and more preferably at least 25%. For purposes of illustration, due to ease of formation of the final fiber, a practical upper limit of crystallinity is 50% (although higher percentages are considered suitable). Generally, the crystallinity will be in a range from 25 to 40%. Due to this crystallinity, such fibers can be dyed, either in intimate blend, yarn, fabric, or article form, but generally require dye assists or more aggressive dyeing conditions. One preferred meta-aramid is poly(metaphenylene isophthalamide).

In some embodiments, the second staple fiber in the intimate blend further comprises a dye. Suitable dyes preferably provide colors that have an "L*" value of 40 or greater, preferably 50 or greater. One preferred range of "L*" values is from 50 to 90.

The blend optionally contains antistat fibers. One suitable fiber is a melt-spun thermoplastic antistatic fiber in an amount of 1 to 3 weight percent, such as those described in U.S. Pat. No. 4,612,150 to De Howitt and/or U.S. Pat. No. 3,803,453 to Hull. These fibers, while they contain carbon black, have a negligible impact on arc performance, since the fiber polymer does not have the combination of being flame resistant and thermally stable; that is, it does not have in combination a LOI of greater than 21 and does not retain at least 90 percent of its weight when heated to 425 degrees Celsius at a rate of 10 degrees per minute. In fact, such thermoplastic antistat fibers lose in excess of 35 weight percent when heated to 425 degrees Celsius at a rate of 10 degrees per minute. For the purposes herein, and to avoid any confusion, the total content in the weight percent of discrete carbon particles is based on the total weight of the fiber blend, excluding any minor amount of antistat fibers.

The intimate blend of staple fibers can be made by cutter blending strands or tows of different fibers or by blending different bales of fibers and other means know in the art of forming an intimate blend. For example, the two or more slivers of different staple fiber types can be blended prior to or while a staple fiber yarn is being spun so that the various staple fibers are distributed homogeneously as an intimate blend in the staple yarn bundle By "yarn" is meant an assemblage of fibers spun or twisted together to form a continuous strand. As used herein, a yarn generally refers to what is known in the art as a singles yarn, which is the simplest strand of textile material suitable for such operations as weaving and knitting; or a ply yarn or plied yarn. A spun staple yarn can be formed from staple fibers with more or less twist. When twist is present in a singles yarn, it is all in the same direction. As used herein the phrases "ply yarn" and "plied yarn" can be used interchangeably and refer to two or more yarns, i.e. singles yarns, twisted or plied together.

Fabrics can be made from the spun staple yarns comprising the intimate blends of staple fibers as described herein and can include, but is not limited to, woven or knitted fabrics. General fabric designs and constructions are well known to those skilled in the art. By "woven" fabric is meant a fabric usually formed on a loom by interlacing warp or lengthwise yarns and filling or crosswise yarns with each other to generate any fabric weave, such as plain weave, crowfoot weave, basket weave, satin weave, twill weave, and the like. Plain and twill weaves are believed to be the most common weaves used in the trade and are preferred in many embodiments.

By "knitted" fabric is meant a fabric usually formed by interlooping yarn loops by the use of needles. In many instances, to make a knitted fabric spun staple yarn is fed to a knitting machine which converts the yarn to fabric. If desired, multiple ends or yarns can be supplied to the knitting machine either plied of unplied; that is, a bundle of yarns or a bundle of plied yarns can be co-fed to the knitting machine and knitted into a fabric, or directly into an article of apparel such as a glove, using conventional techniques. The tightness of the knit can be adjusted to meet any specific need. A very effective combination of properties for protective apparel has been found in for example, single jersey knit and terry knit patterns.

In some particularly useful embodiments, the spun staple yarns comprising the intimate blends of staple fibers can be used to make arc-resistant and flame-resistant garments. In some embodiments the garments can have essentially one layer of the protective fabric made from the spun staple yarn. Garments of this type include jumpsuits, coveralls, pants, shirts, gloves, sleeves and the like that can be worn in situations such as chemical processing industries or industrial or electrical utilities where an extreme thermal event might occur. In one preferred embodiment, the garment is made from the fabric comprising the yarns of the intimate blends of staple fibers described herein. Alternatively, the article of clothing could utilize a sewing threat comprising the intimate blend of staple fibers described herein.

Protective articles or garments of this type include protective coats, jackets, jumpsuits, coveralls, hoods, etc. used by industrial personnel such as electricians and process control specialists and others that may work in an electrical arc potential environment. In a preferred embodiment, the protective garment is a coat or jacket, including a three-quarter length coat commonly used over the clothes and other protective gear when work on an electrical panel or substation is required.

In a preferred embodiment, the protective articles or garments in a single fabric layer have a ATPV of greater than 2 cal/cm$^2$/oz, which is at least a Category 2 arc rating or higher as measured by either of two common category rating systems for arc ratings. The National Fire Protection Association (NFPA) has 4 different categories with Category 1 having the lowest performance and Category 4 having the highest performance. Under the NFPA 70E system, Categories 1, 2, 3, and 4 correspond to a minimum threshold heat flux through the fabric of 4, 8, 25, and 40 calories per square centimeter, respectively. The National Electric Safety Code (NESC) also has a rating system with 3 different categories with Category 1 having the lowest performance and Category 3 having the highest performance. Under the NESC system, Categories 1, 2, and 3 correspond to a minimum threshold heat flux through the fabric of 4, 8, and 12 calories per square centimeter, respectively. Therefore, a fabric or garment having a Category 2 arc rating can withstand a thermal flux of 8 calories per square centimeter, as measured per standard set method ASTM F1959 or NFPA 70E.

In a preferred embodiment, the fabrics and articles preferably have an "L*" value ranging from 50 to 90.

Test Methods

Arc Resistance. The arc resistance of fabrics of this invention is determined in accordance with ASTM F-1959-99 "Standard Test Method for Determining the Arc Thermal Performance Value of Materials for Clothing". Preferably fabrics of this invention have an arc resistance (ATPV) of preferably at least 2 calories per square centimeter per ounce per square yard.

ThermoGravimetric Analysis (TGA). Fiber that retains at least 90 percent of its weight when heated to 425 degrees Celsius at a rate of 10 degrees per minute can be determined using a Model 2950 Thermogravimetric Analyzer (TGA) available from TA Instruments (a division of Waters Corporation) of Newark, Del. The TGA gives a scan of sample weight loss versus increasing temperature. Using the TA Universal Analysis program, percent weight loss can be measured at any recorded temperature. The program profile consists of equilibrating the sample at 50 degrees C.; ramping the temperature 10° C. per minute from 50 to 1000 degrees C.; using air as the gas, supplied at 10 ml/minute; and using a 500 microliter ceramic cup (PN 952018.910) sample container. A specific testing procedure is as follows. The TGA was programmed using the TGA screen on the TA Systems 2900 Controller. The sample ID was entered and the planned temperature ramp program of 20 degrees per minute selected. The empty sample cup was tared using the tare function of the instrument. The fiber sample was cut into approximately 1/16" (0.16 cm) lengths and the sample pan was loosely filled with the sample. The sample weight should be in the range of 10 to 50 mg. The TGA has a balance therefore the exact weight does not have to be determined beforehand. None of the sample should be outside the pan. The filled sample pan was loaded onto the balance wire making sure the thermocouple is close to the top edge of the pan but not touching it. The furnace is raised over the pan and the TGA is started. Once the program is complete, the TGA will automatically lower the furnace, remove the sample pan, and go into a cool down mode. The TA Systems 2900 Universal Analysis program is then used to analyze and produce the TGA scan for percent weight loss over the range of temperatures.

Limited Oxygen Index. The limited oxygen index (LOI) of fabrics of this invention is determined in accordance with ASTM G-125-00 "Standard Test Method for Measuring Liquid and Solid Material Fire Limits in Gaseous Oxidants".

Color Measurement. The system used for measuring color and spectral reflectance is the 1976 CIELAB color scale (L*-a*-b* system developed by the Commission Internationale de l'Eclairage). In the CIE "L*-a*-b*" system, color is viewed as point in three-dimensional space. The "L*" value is the lightness coordinate with high values being the lightest, the "a*" value is the red/green coordinate with "+a*" indicating red hue and "−a*" indicating green hue and the "b*" value is the yellow/blue coordinate with "+b*" indicating yellow hue and "−b*" indicating blue hue. A spectrophotometer was used to measure the color of samples, either in puffs of fiber or in fabric or garment form as indicated. Specifically, a Hunter Lab UltraScan® PRO spectrophotometer was used, including the industry standard of 10-degree observer and D65 illuminant. The color scale used herein uses the coordinates of the CIE ("L*-a*-b*) color scale with the asterisk, as opposed to the coordinates of the older Hunter color scale, which are designated ("L-a-b") without the asterisk.

Weight Percent of Carbon Particles. The nominal amount of carbon black in the fiber, when making the fiber, is determined by a simple mass balance of ingredients. After the fiber is made, the amount of carbon black present in the fiber can be determined by measuring the weight of a sample of fiber, removing the fiber by dissolution of the polymer in a suitable solvent that does not affect the carbon black particles, washing the remaining solids to remove any inorganic salts that are not carbon, and weighing the remaining solids. One specific method includes weighing about a gram of the fiber, yarn, or fabric to be tested and heating that sample in an oven at 105° C. for 60 minutes to remove any moisture, followed by placing the sample in a desiccator to cool to room temperature, followed by weighing the sample to obtain an initial weight to a precision of 0.0001 grams. The sample is then placed in a 250 ml flat bottom flask with a stirrer and 150 ml of a suitable solvent, for example 96% sulfuric acid, is added. The flask is then placed on a combination stir/heater with a chilled water condenser operating with enough flow to prevent any fumes from exiting the top of the condenser. The heat is then applied while stirring until the yarn is fully dissolved in the solvent. The flask is then removed from the heater and allowed to cool to room temperature. The contents of the flask are then vacuum filtered using a Millipore vacuum filter unit with a tared 0.2 micron PTFE filter paper. Remove the vacuum and then rinse the flask out with 25 ml of additional solvent, which is also passed through the filter. The Millipore unit is then removed from the vacuum flask and reset on a new clean glass vacuum flask. With vacuum, the residue on the filter paper is washed with water until a pH paper check on the filtrate indicates the wash water to be neutral. The residue is then finally washed with methanol. The filter paper with residue sample is removed, placed in a dish, and heated in an oven at 105° C. to dry for 20 minutes. The filter paper with residue sample in then put in a desiccator to cool to room temperature, followed by weighing the filter paper with residue sample to obtain the final weight to a precision of 0.0001 grams. The weight of the filter is subtracted from the weight of the filter paper with residue sample. This weight is then divided by the initial weight of the yarn or fiber or fabric and multiplied by 100. This will give the weight percentage of the carbon black in the fiber, yarn, or fabric.

Particle Size. Carbon particle size can be measured using the general provisions of ASTM B822-10—"Standard Test Method for Particle Size Distribution of Metal Powders and Related Compounds by Light Scattering".

Shrinkage. To test for fiber shrinkage at elevated temperatures, the two ends of a sample of multi-filament yarn to be tested are tied together with a tight knot such that the total interior length of the loop is approximately 1 meter in length. The loop is then tensioned until taut and the doubled length of the loop measured to the nearest 0.1 cm. The loop of yarn is then hung in an oven for 30 minutes at 185 degrees Celsius. The loop of yarn is then allowed to cool, it is re-tensioned and the doubled length is re-measured. Percent shrinkage is then calculated from the change in the linear length of the loop.

EXAMPLES

In the examples that follow, unless designated differently, the natural meta-aramid fiber was amorphous or uncrystallized poly(m-phenylene isophthalamide) (MPD-I) fiber, and the natural para-aramid fiber was poly(p-phenylene terephthalamide) (PPD-T); both of these were free of carbon particles, that is, they did not contain any added carbon-black. The black meta-aramid fiber was crystallized MPD-I fiber that further contained carbon particles or carbon-black. The black para-aramid fiber was PPD-T fiber that was made with a mixture of pigments to mimic a black color, but this PPD-T fiber was also free of discrete carbon particles or carbon-black. The antistatic fiber was a carbon-core nylon-sheath fiber known commercially as P140® available from Invista.

The calculated percent total amount of carbon (percent) for the intimate blend (and in the fabric) was based on the weight of the carbon particles in the carbon-containing black meta-aramid fiber, which had a nominal 2.1 weight percent carbon, divided by the weight of the total fiber blend, times 100. Any carbon in the antistat fiber is not considered in the calculation of percent carbon in the blend.

Control Example

An intimate blend of staple fibers in the form of a picker blend sliver of 93 weight percent meta-aramid fiber, 5 weight percent para-aramid fiber, and 2 weight percent antistatic fiber was prepared, and then was made into spun staple yarn using cotton system processing and an air-jet spinning frame. The resultant yarn was a 21 tex (28 cotton count) single yarn. Two single yarns were then plied on a plying machine to make a two-ply yarn having a ply twist of 10 turns/inch twist The yarn was then used as the warp and fill yarns of a fabric that was woven on a shuttle loom in a warp-faced 2×1 twill construction. The finished twill fabric had a construction of approximately 31 ends×16 picks per cm (77 ends×47 picks per inch) and a basis weight of 203 g/m$^2$ (6.0 oz/yd$^2$). The fabric was then submitted for arc testing and the results are shown in the Table.

Example 1

An intimate blend of staple fibers in the form of a picker blend sliver of 85 weight percent natural (white) meta-aramid fiber, 9.4 weight percent carbon-containing black meta-aramid fiber, 5.5 weight percent non-carbon-containing black para-aramid fiber and 0.1 weight percent antistatic fiber was prepared, and then was made into spun staple yarn using cotton system processing and an air-jet spinning frame. The resultant yarn was a 21 tex (28 cotton count) single yarn. Two single yarns were then plied on a plying machine to make a two-ply yarn having a ply twist of 10 turns/inch twist. The yarn was then used as in the warp and fill of a fabric that was woven on a shuttle loom in a warp-faced 2×1 twill construction. The twill fabric had a construction of approximately 31 ends×16 picks per cm (77 ends×47 picks per inch) and a basis weight of 203 g/m$^2$ (6.0 oz/yd$^2$). The fabric was submitted for arc testing and the results are shown in Table 1.

Example 2

Example 1 was repeated except the intimate blend of staple fibers contained 70 weight percent natural (white) meta-aramid fiber, 23.4 weight percent carbon-containing black meta-aramid fiber, 6.3 weight percent non-carbon-containing black para-aramid fiber, and 0.3 weight percent of antistatic fiber. The fabric was submitted for arc testing and the results are shown in Table 1.

Example 3

Example 1 was repeated except the intimate blend of staple fibers contained 50 weight percent natural (white) meta-aramid fiber, 42.2 weight percent carbon-containing black meta-aramid fiber, 7.3 weight percent non-carbon-containing black para-aramid fiber, and 0.5 weight percent of antistatic fiber. The fabric was submitted for arc testing and the results are shown in Table 1.

Comparison Example A

Example 1 was repeated except the intimate blend of staple fibers contained 25 weight percent natural (white) meta-aramid fiber, 65.7 weight percent carbon-containing black meta-aramid fiber, 8.5 weight percent non-carbon-containing black para-aramid fiber, and 0.7 weight percent of antistatic fiber. The fabric was submitted for arc testing and the results are shown in Table 1.

Comparison Example B

Example 1 was repeated except the intimate blend of staple fibers contained no natural (white) meta-aramid fiber, 89.2 weight percent carbon-containing black meta-aramid fiber, 9.8 weight percent non-carbon-containing black para-aramid fiber, and 1.0 weight percent of antistatic fiber. The fabric was submitted for arc testing and the results are shown in Table 1.

TABLE 1

| Ex. | Carbon Containing m-Aramid Fiber, % | Carbon-Free m-Aramid Fiber, % | Carbon-Free p-Aramid Fiber, % | Anti-stat Fiber, % | Total Carbon in Blend, % | Basis Weight, g/m$^2$ (oz/yd$^2$) | "L*" Value, | ATPV, (cal/cm$^2$) |
|---|---|---|---|---|---|---|---|---|
| Control | 0 | 93 | 5 | 2 | 0 | 6.5 | 84 | 6.5 |
| 1 | 9.4 | 85 | 5.5 | 0.1 | 0.21 | 6.3 | 59 | 9.8 |
| 2 | 23.4 | 70 | 6.3 | 0.3 | 0.52 | 6.3 | 47 | 11.5 |
| 3 | 42.2 | 50 | 7.3 | 0.5 | 0.94 | 6.2 | 37 | 11.9 |
| A | 65.7 | 25 | 8.5 | 0.7 | 1.46 | 6.5 | 28 | 13.4 |
| B | 89.2 | 0 | 9.8 | 1.0 | 1.98 | 6.5 | 19 | 13.0 |

As illustrated by the arc performance (ATPV), the composition of intimate blend of staple fibers reaches a point of diminishing returns when the amount of carbon-containing staple fiber is about 50 percent or higher of the blend. Likewise, such blends illustrate darker shades that are more difficult to mask.

Example 4

Intimate blends of natural poly(m-phenylene isophthalamide) (MPD-I) fiber that was free of carbon particles and MPD-I fiber that contained carbon particles (black fiber) were made across the entire compositional range (0 to 100%). The compositions are shown in Table 2. Each blend was carded to create a "puff" ball of fibers for lightness measurement. The L* value for each blend was measured using a HunterLab UltraScan® PRO spectrophotometer with the following viewing conditions: Large Area View/10-degree observer/D65 illuminant. The color scale used for reporting L* values is the CIE 1976 L*a*b* (CIELAB) color scale. A low value on this scale indicates a dark shade, while a high value indicates a light shade. As summarized in Table 2, the L* value increases with decreasing amounts of the black MPD-I fiber.

FIG. 1 shows the relationship of the measured lightness value L* graphically across the entire compositional range, illustrating that surprisingly the lightness of the blends is not governed by a simple rule of mixtures.

TABLE 2

| Percent Black Fiber | Percent Natural Fiber | L* Value | a* Value | b* Value |
|---|---|---|---|---|
| 0 | 100 | 96 | −0.30 | 2.85 |
| 3 | 97 | 80 | −0.04 | 0.45 |
| 5 | 95 | 76 | 0.04 | 0.21 |
| 10 | 90 | 67 | 0.1 | −0.11 |
| 15 | 85 | 62 | 0.05 | −0.38 |
| 25 | 75 | 54 | 0.12 | −0.47 |
| 35 | 65 | 48 | 0.11 | −0.61 |
| 50 | 50 | 39 | 0.12 | −0.65 |
| 75 | 25 | 29 | 0.08 | −0.92 |
| 100 | 0 | 20 | 0.02 | −1.1 |

What is claimed is:

1. An intimate blend of staple fibers, comprising a mixture of:

i) 3 to 80 weight percent of a first staple fiber made from a first polymer having a limiting oxygen index greater than 21 and retaining at least 90 percent of its weight when heated to 425 degrees Celsius at a rate of 10 degrees per minute, the first staple fiber further comprising 0.5 to 20 weight percent discrete carbon particles homogeneously dispersed in that fiber; and ii) 20 to 97 weight percent of either:

a) a second staple fiber being free of discrete carbon particles and having an L* lightness coordinate of 70 or greater, the second staple fiber being capable of accepting a dye or coloration and made from a second polymer having a limiting oxygen index of greater than 21, or b) a second staple fiber blend being free of discrete carbon particles and comprising at least one second staple fiber, the second staple fiber having an L* lightness coordinate of 70 or greater, being capable of accepting a dye or coloration, and made from a second polymer having a limiting oxygen index of greater than 21;

the mixture having a total content of 0.5 to 3 weight percent discrete carbon particles;

wherein the first and second polymer is a meta-aramid polymer.

2. The intimate blend of claim 1 wherein the weight percent of the first staple fiber in i) is 3 to 49 weight percent, and the weight percent of a) or b) in ii) is 51 to 97 weight percent.

3. The intimate blend of claim 2 wherein the weight percent of the first staple fiber in i) is 5 to 35 weight percent, and the weight percent of a) or b) in ii) is 65 to 95 weight percent.

4. The intimate blend of claim 3 wherein the weight percent of the first staple fiber in i) is 10 to 25 weight percent, and the weight percent of a) or b) in ii) is 75 to 90 weight percent.

5. The intimate blend of claim 1 wherein the first staple fiber comprises 0.5 to 6 weight percent discrete carbon particles.

6. The intimate blend of claim 1 wherein the meta-aramid is poly(meta-phenylene isophthalamide).

7. The intimate blend of claim 1 wherein the second staple fiber further comprises a dye.

8. A yarn comprising the intimate blend of claim 1.

9. A fabric comprising the yarn of claim 8.

10. An article of clothing or garment comprising the yarn of claim 9.

11. An intimate blend of staple fibers, comprising a mixture of:

i) 3 to 49 weight percent of a first staple fiber made from a first polymer having a limiting oxygen index greater than 21 and retaining at least 90 percent of its weight when heated to 425 degrees Celsius at a rate of 10 degrees per minutes, the first staple fiber further comprising 0.5 to 20 weight percent discrete carbon particles homogeneously dispersed in that fiber; and ii) 51 to 97 weight percent of either:

a) a second staple fiber being free of discrete carbon particles, the second staple fiber being capable of accepting a dye or coloration and made from a second polymer having a limiting oxygen index of greater than 21, or b) a second staple fiber blend being free of discrete carbon particles and comprising at least one second staple fiber, the second staple fiber being capable of accepting a dye or coloration and made from a second polymer having a limiting oxygen index of greater than 21;

the mixture having a total content of 0.5 to 3 weight percent discrete carbon particles;

wherein the first and second polymer is a meta-aramid polymer.

12. The intimate blend of claim 11 wherein the weight percent of the first staple fiber in i) is 5 to 35 weight percent, and the weight percent of a) or b) in ii) is 65 to 95 weight percent.

13. The intimate blend of claim 12 wherein the weight percent of the first staple fiber in i) is 10 to 25 weight percent, and the weight percent of a) or b) in ii) is 75 to 90 weight percent.

14. The intimate blend of claim 11 wherein the first staple fiber comprises 0.5 to 6 weight percent discrete carbon particles.

15. The intimate blend of claim 11 wherein the meta-aramid is poly(meta-phenylene isophthalamide).

16. The intimate blend of claim 11 wherein the second staple fiber further comprises a dye.

17. A yarn comprising the intimate blend of claim 11.

18. A fabric comprising the yarn of claim 17.

19. An article of clothing or garment comprising the yarn of claim 18.

* * * * *